United States Patent [19]

Mindheim, deceased et al.

[11] 3,942,856

[45] Mar. 9, 1976

[54] SAFETY SOCKET ASSEMBLY

[76] Inventors: Daniel J. Mindheim, deceased, late of San Jose, Calif., by Joyce E. Mindheim, executrix, 20020 Rodrigues Ave., Apt. D., Cupertino, Calif. 95014

[22] Filed: Dec. 23, 1974

[21] Appl. No.: 535,486

[52] U.S. Cl. ..... 339/74 R; 339/36

[51] Int. Cl.[2] ..... H01R 13/54

[58] Field of Search ..... 174/67; 339/36, 39, 40, 339/42, 78, 79, 74 R

[56] References Cited

UNITED STATES PATENTS

| | | | |
|---|---|---|---|
| 2,610,999 | 9/1952 | Silver | 339/36 |
| 2,770,786 | 11/1956 | Chelton | 174/67 X |
| 3,775,726 | 11/1973 | Gress | 339/40 X |

*Primary Examiner*—Roy Lake
*Assistant Examiner*—Howard N. Goldberg
*Attorney, Agent, or Firm*—Flehr, Hohbach, Test, Albritton & Herbert

[57] ABSTRACT

Safety socket assembly for use with a conventional wall outlet for preventing injury to persons such as children who insert foreign objects into the socket. Energization of the socket is controlled by a set of contacts, and the socket can only be energized when a plug is inserted therein. Once the plug is inserted and the socket energized, the plug is locked in place and cannot be removed until the socket is deenergized.

9 Claims, 7 Drawing Figures

SAFETY SOCKET ASSEMBLY

BACKGROUND OF THE INVENTION

This invention pertains generally to electrical outlets and connectors and more particularily to a safety socket assembly for preventing injury to persons such as children who insert foreign objects into the socket.

SUMMARY AND OBJECTS OF THE INVENTION

The safety socket assembly of the invention can be used with a conventional wall outlet, and it includes a socket which can only be energized when a plug is inserted therein. Energization of the socket is controlled by a set of contacts which are opened by a cam carried by a plunger. The plunger is movable between axially extended and retracted positions and between first and second rotative positions. The contacts are closed only when the plunger is extended and in its first rotative position, and a stop prevents movement of the plunger to the extended position unless a plug is inserted in the socket. A pin carried by the plunger passes through an opening in the prong of the plug inserted in the socket and prevents insertion or removal of the plug when the plunger is in the extended position.

It is in general an object of the invention to provide a new and improved safety socket assembly.

Another object of the invention is to provide a safety socket assembly of the above character which is suitable for use with a conventional wall outlet.

Another object of the invention is to provide a safety socket assembly of the above character in which a socket is deenergized unless a plug is inserted therein.

Additional objects and features will be apparent from the following description in which the preferred emblodiment is set forth in detail in conjunction with the accompanying drawing.

DESCRIPTION OF THE PREFERRED EMBODIMENT

Figure 1:
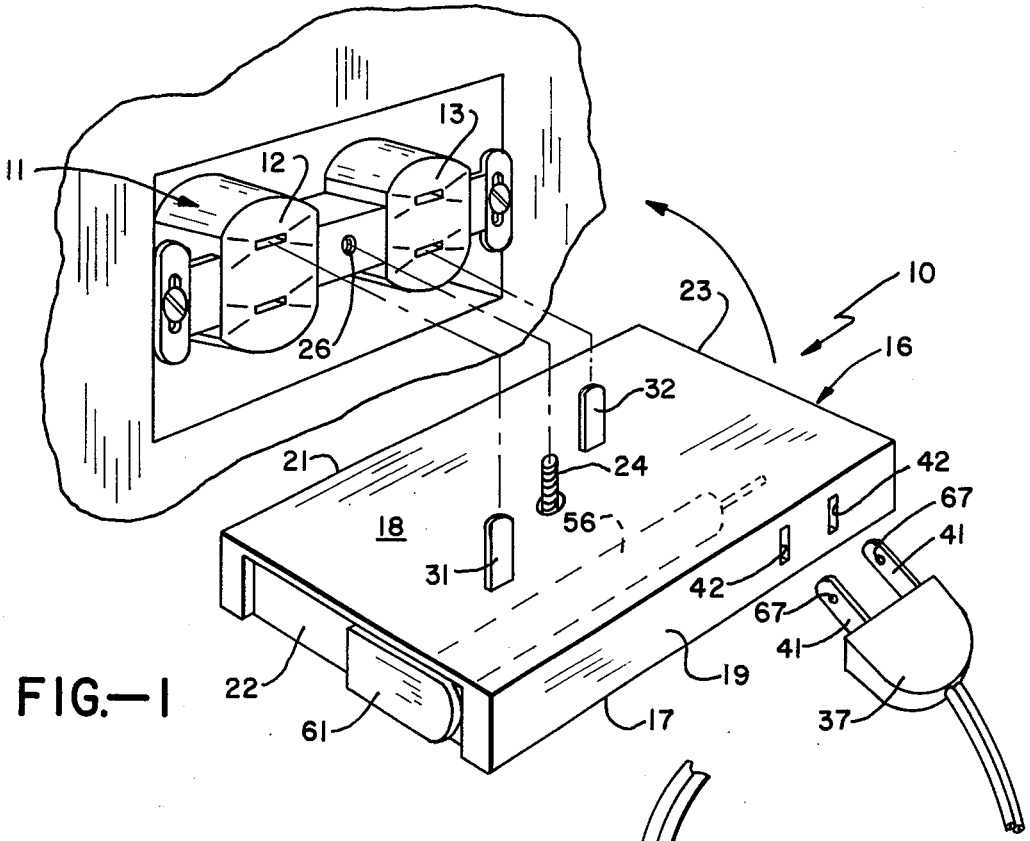
FIG. 1 is a perspective view of one embodiment of a safety socket assembly according to the invention, illustrating the use of the assembly with a conventional wall outlet.
Figure 2:
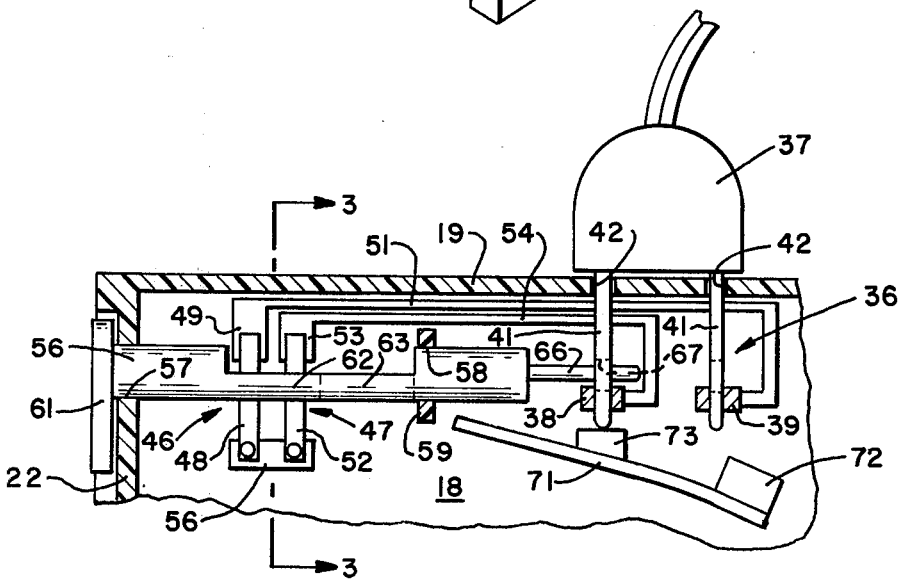
FIG. 2 is a frangmentary sectional view of the safety socket assembly of FIG. 1, illustrating the plunger in its extended position, with the socket energized.

In FIG. 1, the socket assembly, designated generally by reference numeral 10, is illustrated in connection with a conventional duplex wall outlet having a pair of sockets or receptacles 12, 13 for receiving the plug of an electrical appliance. Socket assembly 10 includes a generally rectangular housing 16 which is adapted to be mounted on the front of outlet 11 in place of conventional cover plate. In the preferred embodiment, housing 16 is fabricated of an insulative material such as plastic, and it includes a front wall 17, a rear wall 18, a top wall 19, a bottom wall 21, and end walls 22, 23. The socket assembly is secured to the outlet by means of a mounting screw 24 which extends through the assembly and engages a threaded opening 26 in the outlet. Such openings are commonly provided in wall outlets for receiving the mounting screws of cover plates.

The socket assembly also includes a pair of electrically conductive pins 31, 32 which extend from the rear wall 18 of housing 16. These pins are positioned to extend into sockets 12 and 13 and make contact with the energized conductors therein when the socket assembly is mounted on the outlet.

A socket 36 is provided in housing 16 for receiving the plug 37 of an electrical appliance. In the embodiment illustrated, this socket includes contacts 38 and 39 for engaging the prongs 41 of plug 37. The socket also includes openings 42 formed in the top wall 19 of the housing in alignment with contacts 38, 39.

Two sets of contacts 46, 47 are mounted in housing 16 and control the energization of socket 36. The first set includes a movable contact 48, which is connected to pin 31 by a suitable conductor, not shown, and a fixed contact 49 which is connected to socket contact 39 by a conductor 51. The second set includes a movable contact 52 connected to pin 32 by a suitable conductor, not shown, and a fixed contact 53 connected to socket contact 38 by a conductor 54. As illustrated, movable contacts 48 and 52 are mounted on a mounting block 56 carried by the rear wall 18 of housing 16, and the contacts are biased toward a normally open position, i.e. out of engagement with contacts 49 and 53.

A control arm comprising a generally cylindrical plunger 56 is rotatively mounted in housing 16 and movable between axially extended and retracted positions. For this purpose, the outer portion of the plunger is journalled in an opening 57 formed in end wall 22, and the inner portion is journalled in an opening 58 formed in a mounting block 59. A control lever 61 is fixed to the housing for moving the plunger between its extended and retracted positions and between first and second rotative positions.

Figure 3:
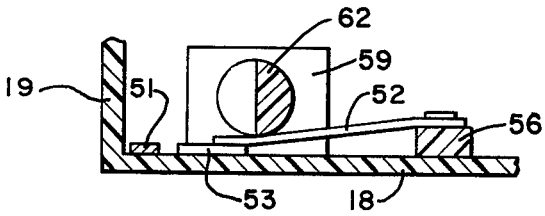
FIG. 3 is a cross sectional view taken along line 3—3 in FIG. 2.
Figure 4:
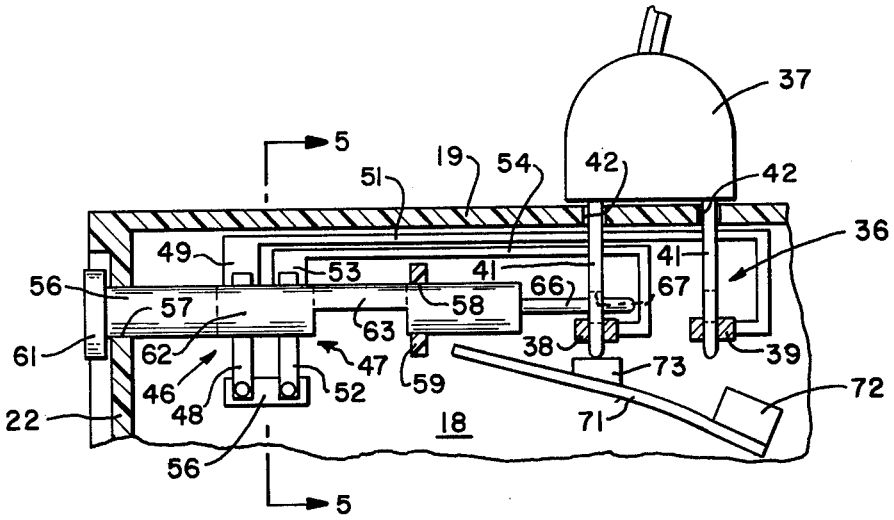
FIG. 4 is a fragmentary sectional view of the socket assembly of FIG. 1, illustrating the plunger in its extended position, with the socket deenergized.
Figure 5:
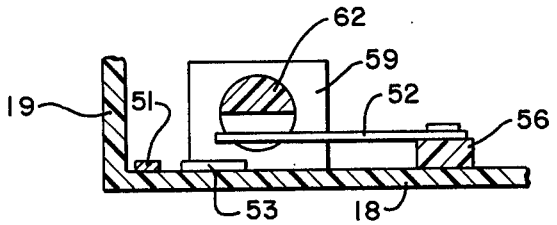
FIG. 5 is a cross sectional view taken along line 5—5 in FIG. 4.

A cam 62 carried by plunger 56 is aligned with contacts 46 and 47 when the plunger is in its extended position. In the preferred embodiment, cam 62 is formed integrally with the plunger, and it consists of a half round section, as best seen in FIGS. 3 and 5. Adjacent to the half round cam section, plunger 56 is formed to include a quarter round section 63 which is aligned with the contacts when the plunger is in its retracted position.

A locking pin 66 extends axially from the inner end of plunger 56 in position to extend through the opening 67 in the prong of a plug inserted in socket 36 when the plunger is in its extended position. As discussed more fully hereinafter, the locking pin prevents removal or insertion of a plug when the plunger is in its extended position.

Means is provided for preventing movement of the plunger to its extended position when no plug is in socket 36. This means includes a resilient stop arm 71 mounted at one end to a mounting block 72. In its rest position, the free end of the arm is aligned axially with the plunger and serves as a stop or limiting abutment for the same. A knife edge 73 carried by arm 71 is positioned to be engaged by the prong of a plug inserted in socket 36, whereby the arm is deflected out of alignment with the plunger when a plug is inserted in the socket.

Figure 6:
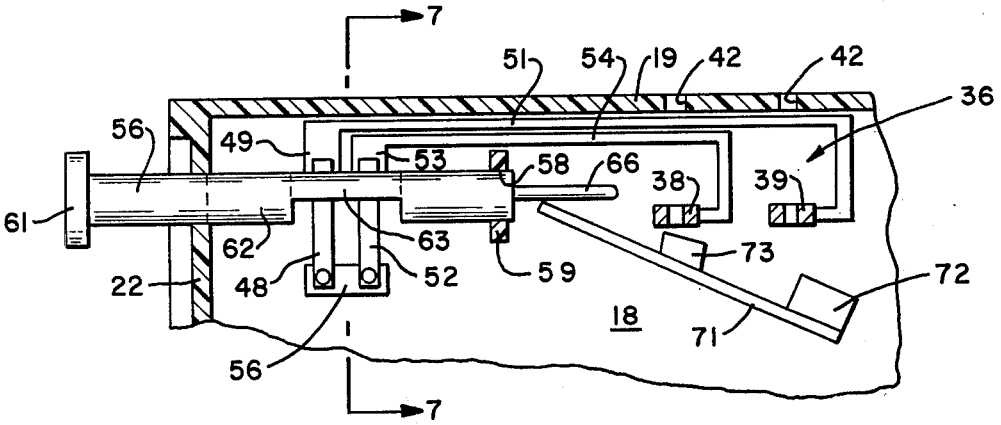
FIG. 6 is a fragmentary sectional view of the socket assembly of FIG. 1, illustrating the plunger in its retracted position, with the socket deenergized.
Figure 7:
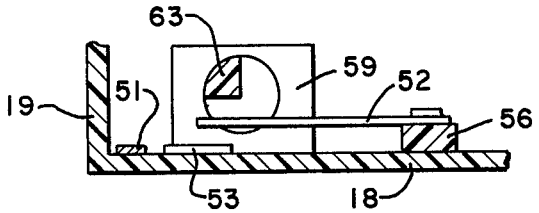
FIG. 7 is a cross sectional view taken along line 7—7 in FIG. 6.

Operation and use of the safety socket assembly can now be described. It is assumed that the assembly has been mounted on the face of a conventional wall outlet which is energized in the usual manner. Before a plug 37 is inserted into socket 36, plunger 56 is moved to its second rotative position and withdrawn or retracted, as illustrated in FIG. 6. The plug is then inserted into the socket, and one prong of the plug deflects stop arm 71 out of alignment with plunger 56. The plunger is then moved to its extended position and rotated to its first rotative position whereupon cam 62 engages contacts 48 and 52, closing the contacts and energizing socket 36.

Removal of the plug while the socket is energized is prevented by the presence of locking pin 66 in the opening 67 in prong 41. In order to remove the plug, it is first necessary to deenergize the socket by moving the plunger to its retracted position. With the plunger in the retracted position, contacts 46 and 47 will be open and the socket will be deenergized regardless of the rotative position of the plunger.

Stop arm 71 prohibits movement of the plunger to the extended position unless a plug is present in the socket. In the event that someone deflects the stop arm by means of a solid object inserted into the socket, pin 66 will strike the solid object and prevent further movement of the plunger toward the extended position.

The invention has a number of important features and advantages. It provides a safety socket assembly on which a socket can only be energized when a plug is inserted in it. Once the plug is inserted and the socket energized, the plug is locked in place and cannot be removed until the socket is deenergized. Consequently, foreign objects can only be inserted when the socket is deenergized and there is no danger of shock or other injury. If desired, more than one protected socket can be included in a single assembly. For example, a second socket can be provided along the bottom wall of the embodiment disclosed.

It is apparent from the foregoing that a new and improved safety socket has been provided. While only the preferred embodiment has been described, as will be apparent to those familiar with the art, certain changes and modifications can be made without departing from the scope of the invention as defined by the following claims.

It is claimed:

1. In a safety socket assembly: a socket for receiving the prongs of the connecting plug of an electrical appliance, a set of contacts for connecting the socket to a source of electrical energy when closed, a control arm movablee relative to the contacts and socket between extended and retracted positions and between first and second rotative positions, a cam carried by the control arm for holding the contacts in a closed position when the control arm is extended and in its first rotative position, the contacts being open when the control arm is retracted or in its second rotative position, a pin carried by the control arm positioned to extend through an opening in one of the prongs of a plug inserted in the socket to prevent removal of the plug when the control arm is in its extended position, and means for preventing movement of the control arm to the extended position when no plug is in the socket.

2. The socket assembly of claim 1 wherein the control arm and cam are formed as a unitary structure comprising an elongated cylindrical plunger having a half round section positioned for engaging the contacts when the control arm is in its extended position.

3. The socket assembly of claim 2 wherein the plunger also has a quarter round section positioned for alignment with the contacts when the control arm is retracted, said quarter round section being oriented so that it does not engage the contacts to close the same when the control arm is in either rotative positions.

4. The socket assembly of claim 1 wherein the means for preventing movement of the control arm comprises a stop biased toward a rest position in alignment with the control arm and serving as a limiting abutment for the control arm when in the rest position, said stop including a portion adapted to be engaged by the prong of a plug inserted in the socket whereby the stop is moved out of alignment with the control arm when the plug is inserted.

5. The socket assembly of claim 1 wherein the elements named therein are mounted in a housing adapted to be mounted on the front of a conventional wall outlet, said assembly further including a pair of conductive pins connected to the contacts and extending from the housing for contacting the conductors in the outlet.

6. The assembly of claim 5 further including a mounting screw extending from the housing for securing the assembly to the outlet.

7. In a safety socket assembly: a housing adapted to be mounted on the front of a conventional wall outlet, a pair of conductive pins extending from the housing for making electrical contact with the conductors in the outlet, a socket carried by the housing for receiving the prongs of the plug of an electrical appliance, a generally cylindrical plunger rotatively mounted in the housing and movable between first and second axial positions, a locking pin extending axially from one end of the plunger and positioned to extend through an opening in one of the prongs of a plug inserted in the socket to prevent removal of the plug when the plunger is in its first position, said pin being withdrawn from the socket to permit insertion and removal of the plug when the plunger is in its second position, a set of contacts connected to one of the conductive pins and to the socket for making a circuit between the pin and socket when closed, means connecting the second conductive pin to the socket, a cam carried by the plunger positioned for closing the contacts to energize the socket when the plunger is in its first axial position and in a predetermined rotative position, and means for preventing movement of the plunger to its first position when no plug is in the socket.

8. The socket assembly of claim 7 wherein the means for preventing movement of the plunger comprises a movable stop biased toward a rest position in axial alignment with the plunger and serving as a limiting abutment for the plunger when in the rest position, said stop being adapted for being engaged by the prong of a plug inserted in the socket whereby the stop is moved out of alignment with the plunger when the plug is inserted.

9. The socket assembly of claim 7 further including a mounting screw extending through the housing for engaging a threaded opening in the outlet to secure the assembly to the outlet.

* * * * *